United States Patent [19]

Norris et al.

[11] Patent Number: 4,764,998

[45] Date of Patent: Aug. 23, 1988

[54] RETRACTABLE COVER

[75] Inventors: Kevin N. Norris, Normanhurst; Vaughan Dobbyns, Lindfield; David A. Richards, Peakhurst; Stephen T. Garrood, The Rocks; Neville L. Cousins, 70 Muston Street, Mosman, New South Wales 2088, all of Australia

[73] Assignees: Neville Lawrence Cousins, New South Wales, Australia; Santolina Securities Limited, London, England

[21] Appl. No.: 44,507

[22] PCT Filed: Jun. 4, 1986

[86] PCT No.: PCT/AU86/00164

§ 371 Date: Feb. 13, 1987

§ 102(e) Date: Feb. 13, 1987

[87] PCT Pub. No.: WO87/00228

PCT Pub. Date: Jan. 15, 1987

[30] Foreign Application Priority Data

| | | | |
|---|---|---|---|
| Jun. 28, 1985 | [AU] | Australia | PH1249 |
| Oct. 24, 1985 | [AU] | Australia | PH3079 |
| Feb. 21, 1986 | [AU] | Australia | PH4726 |

[51] Int. Cl.[4] ..... E04H 3/19; A63C 19/12

[52] U.S. Cl. ..... 4/502; 4/498; 4/500; 242/76; 242/86.52

[58] Field of Search ..... 4/498, 500, 501, 502, 4/503, 504; 242/67.1 R, 76, 86.52

[56] References Cited

U.S. PATENT DOCUMENTS

| | | | |
|---|---|---|---|
| 2,898,607 | 8/1959 | McGuire | 4/502 |
| 3,747,132 | 7/1973 | Foster | 4/502 |
| 4,324,370 | 4/1982 | Guard et al. | 4/502 |
| 4,422,193 | 12/1983 | Kravath | 4/502 X |
| 4,459,711 | 7/1984 | Sartain et al. | 4/502 |
| 4,467,978 | 8/1984 | Farrington | 4/502 X |
| 4,471,500 | 9/1984 | Long et al. | 4/499 |
| 4,480,800 | 11/1984 | Öberg et al. | 242/67.1 R |

*Primary Examiner*—Henry K. Artis
*Attorney, Agent, or Firm*—Ladas & Parry

[57] ABSTRACT

Retracting cover device for covering structures such as vehicles, swimming pools, boats, awnings etc., comprising a cover of wide flexible sheet material, a reel rotatably mounted on reel support means for winding on and winding off the cover, retracting mechanism for rotating the reel to wind up the cover thereon for storage, said reel being of vary narrow width compared to the cover width and means for gathering the cover to enable winding onto the narrow reel.

28 Claims, 8 Drawing Sheets

RETRACTABLE COVER

TECHNICAL FIELD

This invention relates to a retracting cover device for covering structures such as vehicles, swimming pools, boats, awnings etc. The cover device is primarily designed to protect the structure from the weather but in a preferred embodiment an intrusion and theft alarm is provided.

BACKGROUND ART

Presently known covers are unfolded by hand and spread over the structure and then when the cover is not required it is removed and folded by hand and then stowed somewhere until required again. The awkward and time consuming handling of such covers make them unacceptable to the users.

DISCLOSURE OF INVENTION

The invention provides a retracting cover device for structures such as vehicles, swimming pools, boats, awnings etc., comprising a cover of wide flexible sheet material, a reel rotatably mounted on reel support means for winding on and winding off the cover, retracting mechanism for rotating the reel to wind up the cover thereon for storage, said reel being of very narrow width compared to the cover width and means for gathering the cover to enable winding onto the narrow reel.

Where it is desireable to protect the retracted cover such as when the device is mounted under a vehicle, an enclosure or housing is provided and this housing would normally form part of the reel support means.

The cover would usually be of light weight material and may be shower proof and unaffected by the elements. The cover would be wide enough to cover the top of the structure and the sides as well where necessary. A funnel shaped shute or collector bell mouth is provided to gather the cover to feed it either directly or through a delivery tube to the reel in the housing. These components may be fitted as original equipment and built into the structure at any convenient position. Alternatively the device may be fitted as a unit to existing structures.

An alarm system may be incorporated into the cover to prevent unauthorised access to the structure or theft of the cover itself.

The reel may be rotated by an electric motor and in this case disengaging means may be provided between the reel and the motor so that the reel can free-wheel when the cover is being manually withdrawn from the housing.

A spring motor arrangement may also be used to rotate the reel.

BRIEF DESCRIPTION OF DRAWINGS

By way of example only, the invention is now described with reference to the accompanying drawings in which.

MODES FOR CARRYING OUT THE INVENTION

Figure 1:
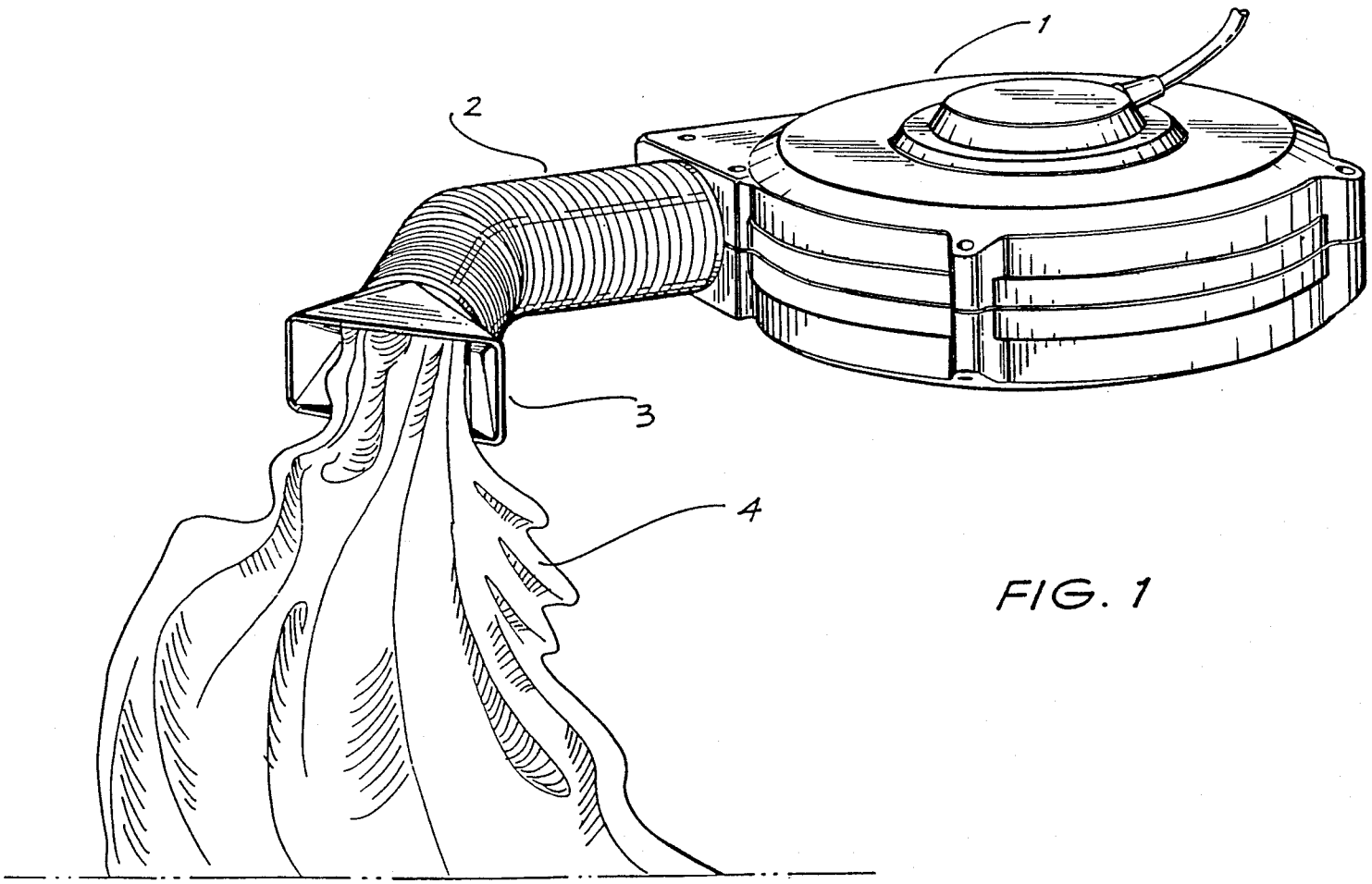
FIG. 1 is a general layout of the cover device.

FIG. 1 shows a general arrangement of the cover device in which the housing 1 is connected to the delivery shute 2 having a bell mouth 3 at its outer end through which the cover 4 is gathered and withdrawn onto the reel. The housing 1 would usually be of generally cylindrical shape to house the reel. The available space, say under a motor vehicle, would also have a bearing on the side and shape of the housing. The bell mouth could be positioned in an outer body panel of a motor vehicle or under the front or rear ends of the motor vehicle. While the bell mouth 3 may be fitted directly onto the housing 1 the positioning of the housing may make it necessary to have a delivery shute to convey the cover from the bell mouth 3 into the housing 1. While the size and shape of the bell mouth and delivery tube are not critical there dimensions must be such that the wider cover is gathered so that it will wind onto the relatively narrow reel. As examples, a 3 inches (8 cms) diameter bell mouth or a rectangular bell mouth 4 inches (10 cms) by 2 inches (5 cms) effectively gathers a 9 ft (3 meters) wide cover for guiding the cover into a 3 inch (8 cms) delivery tube then through a similar sized opening in the housing and onto a 4 inch (10 cms) wide reel. The housing 1 may have drainage holes for any water that may collect inside and part of the housing may be detachable so the cover can be removed for cleaning.

Figure 2:
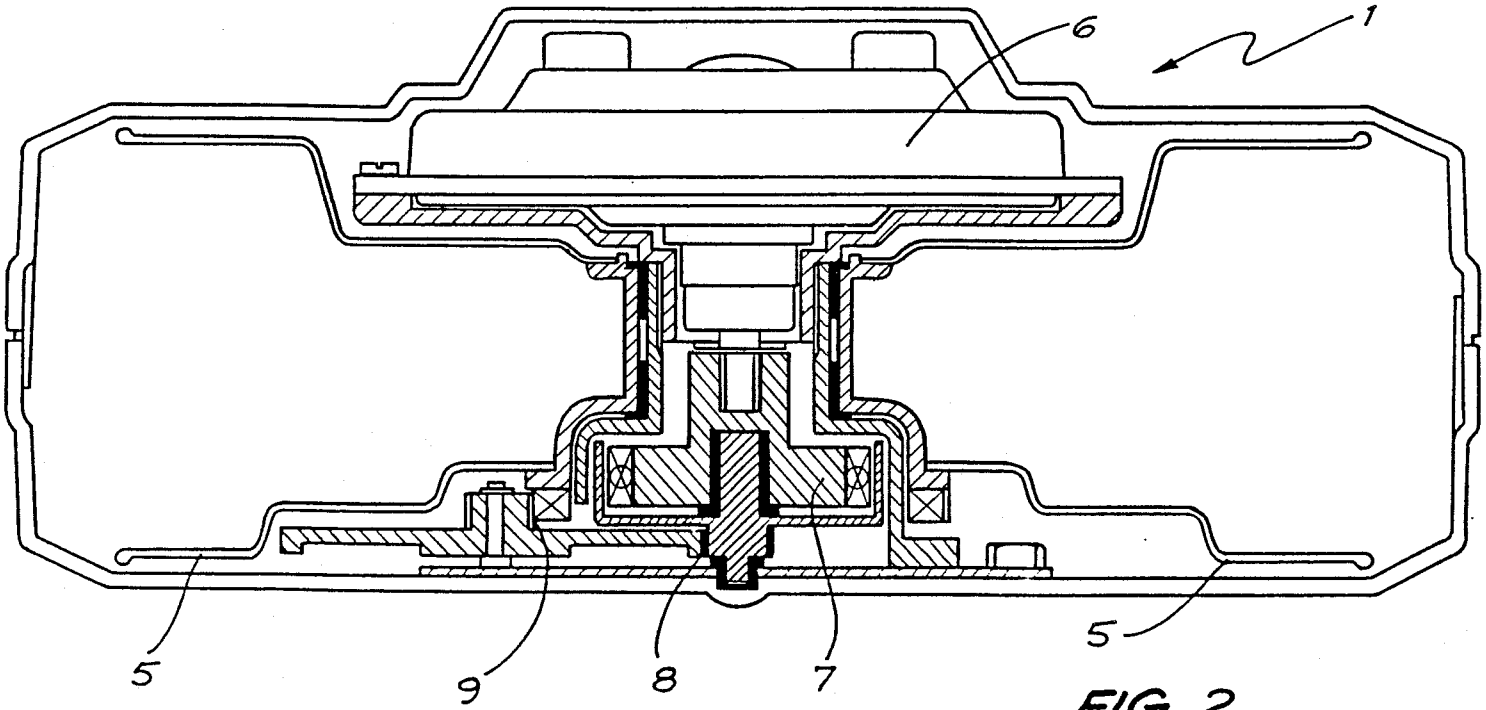
FIG. 2 is an electrically driven example with a first disengaging means.

In one form the cover is attached to the drum by a short length of cable so that when the cover is fully extracted it is free of the bell mouth 3. The cable may be provided with a flexible steel core to provide physical strength and an insulated copper conductor or conductors for electrical connection to the alarm system in the cover. When the cover is retracted a blanking plug, attached to the outer end of the cover may be drawn into the bell mouth where it may lock into position. The blanking plug would be drawn into position by the retracting means:

FIG. 2 shows the housing 1 which contains an electrically driven reel with disengaging means so that the reel can free-wheel when the cover is being withdrawn. The reel 5 is rotated by an electric motor 6 for winding on the gather cover and the cover is unwound by the user pulling it out of the bell mouth. Disengaging means between the motor 6 and the reel 5 are provided so that the reel free-wheels when the cover is being withdrawn.

In one form the disengaging means comprises a centrifical clutch 7 designed to engage when the electric motor reaches approximately 1500 r.p.m. A series of reduction gears 8 and 9 reduce the rotational speed of the reel to about 60 r.p.m.

The electric motor 6 may be controlled by a switch attached to the outer end of the car cover. The free end of the cover may also contain a mechanical lock which may be lockable over the bell mouth to provide security for the cover when stowed. When the cover is over the car the switch and lock is locked to a fitting on the car for physical security and also for a possible alarm circuit.

Figure 3:
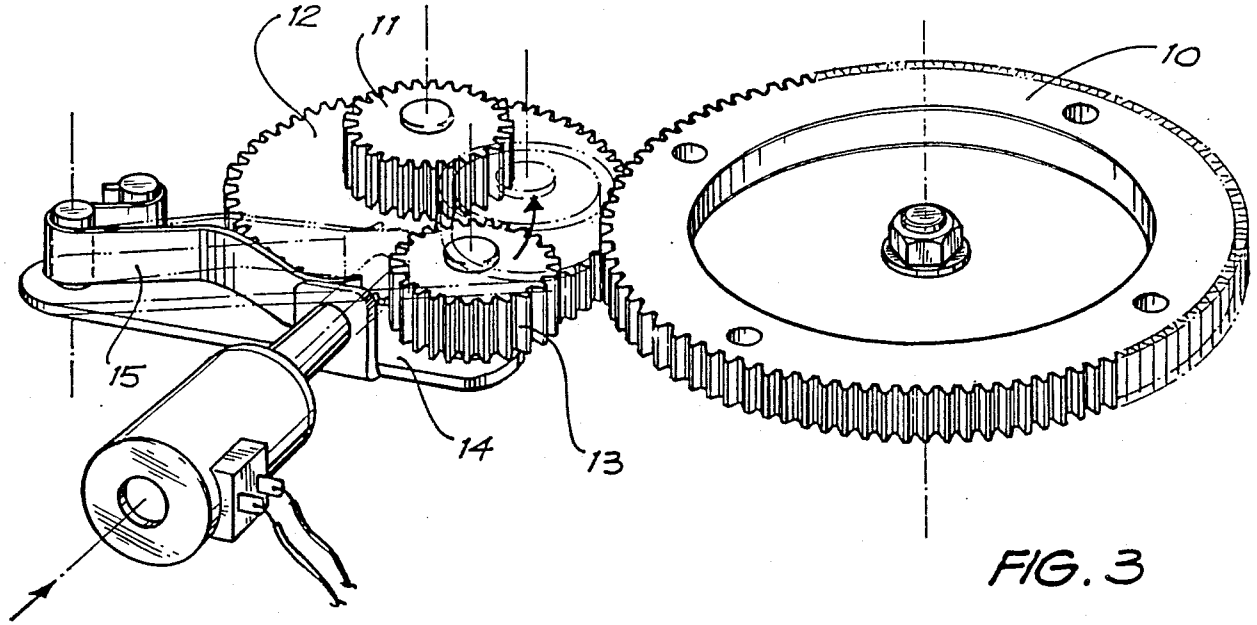
FIG. 3 is an electrically driven example with a second disengaging means.
Figure 4A:
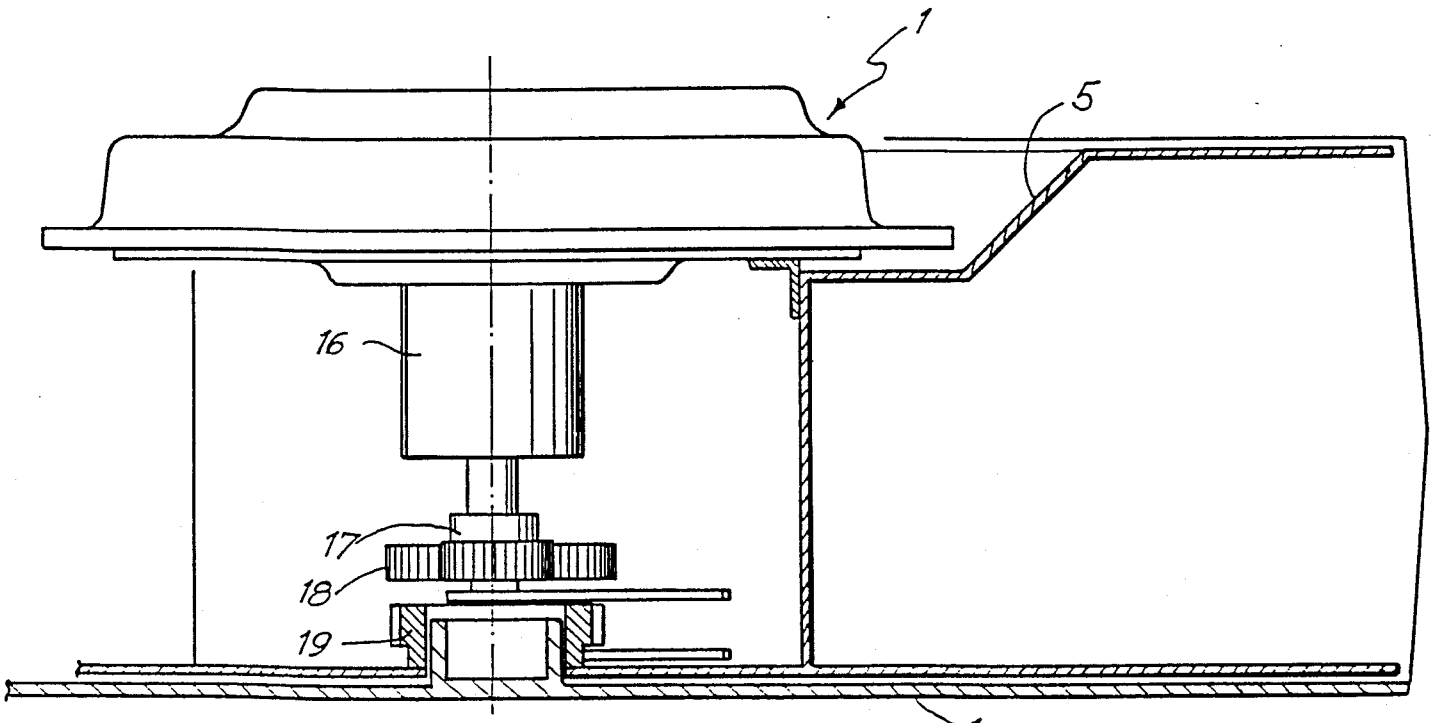
FIGS. 4A to 4E is an electrically driven example with a third disengaging means.
Figure 4B:
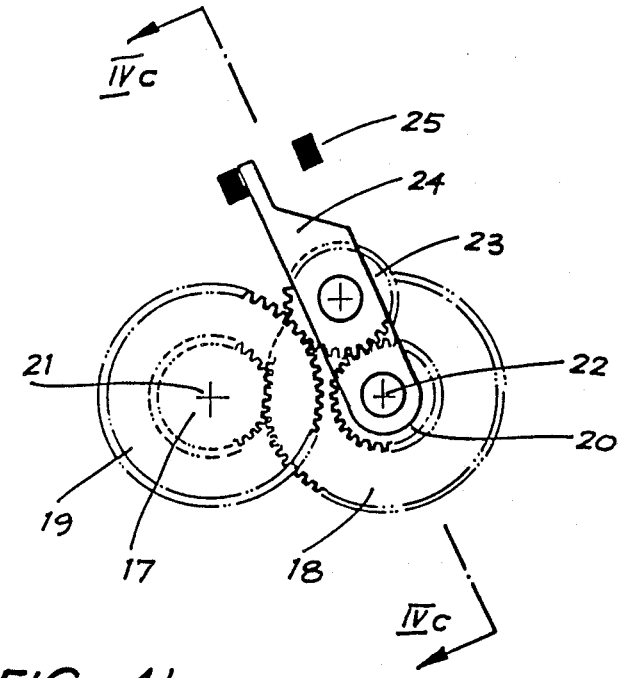
Figure 4C:
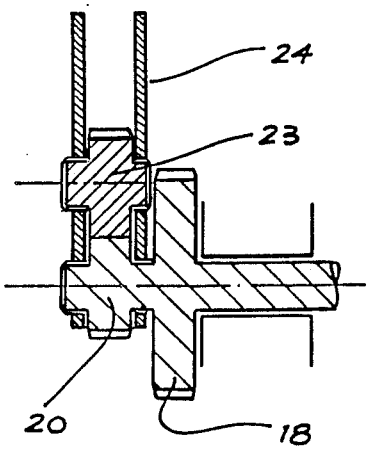
Figure 4D:
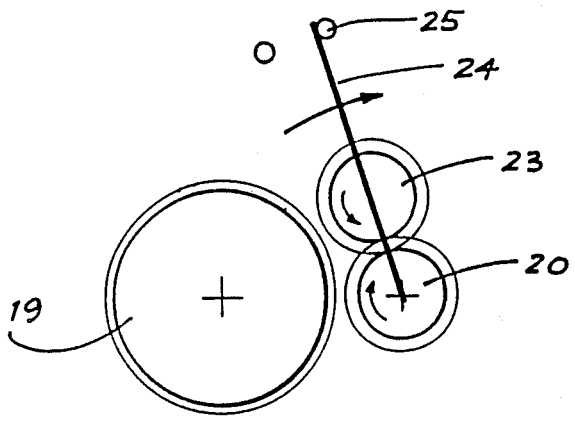
Figure 4E:
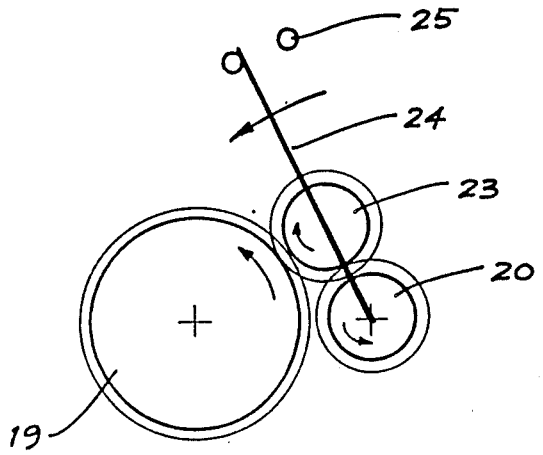

FIG. 3 shows another form of disengaging means. Gear 10 is driven by the motor 6 and gears 11 and 12 drive the reel, sprocket 13 is mounted on a pivotted arm 14 such that when the switch to initiate retraction is switch on the solenoid is energized and the sprocket 13 is moved into engagement between the gears 10 and 11 so that the reel is rotated. When the current is switch off spring 15 disengages the sprocket 13. The same switch could be used to energize both the solenoid and the motor.

FIGS. *4a, 4b, 4c, 4d* and *4e* show another form of disengaging means.

A motor gear box arrangement 16 drives a pinion 17 which measures with a gear 18, gears 19 and 20 have fixed centers at 21 and 22 and do not mesh. Gear 23 is mounted on an arm 24 which is free to pivot about point 22. Gears 20 and 23 are permanently meshed. Stops 25 limit the movement of the arm 24 and the gear 23.

If the motor drives gear 18 and hence gear 20 in an anticlockwise direction the arm 24 will also move in an anticlockwise direction and the gear 23 will mesh with the gear 19 thus rotating the reel. In this position the forces on the teeth of the gears are such as to hold gear 23 in engagement with gear 19.

If the motor is now stoped and then reversed in direction the gear 20 rotates in a clockwise direction and causes the arm 24 to move in a clockwise direction until the stop 25 is reached at which time gear 23 is free of engagement with gear 19. The reel is then free to turn for withdrawal of the cover from the housing.

Figure 5:
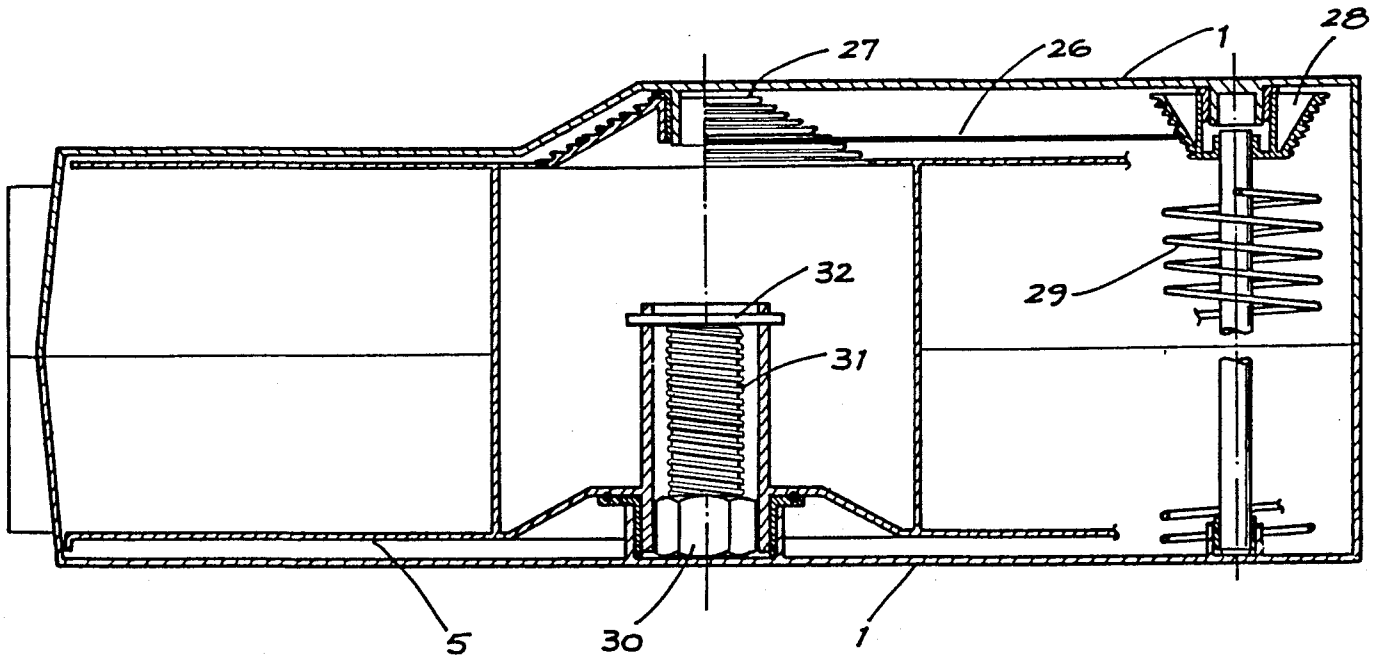
FIG. 5 is a spring driven example.

FIG. 5 shows an embodiment of the invention wherein the reel is rotated by the action of a spring. The basic characteristic of this type of mechanism is that energy is stored in the spring when the cover is withdrawn and this energy is later used to retract the cover. In any such device it is desireable to have some rewind tension available when the cover is completely retracted and this is accomplished by pretensioning of the spring.

When the cover is withdrawn the reel rotates and a cord 26 is wound onto the fusee pully 27. The cord is attached at its other end to a fusee pully 28 which is connected to the spring 29. At the start of the cover withdrawal the cord 26 is fully wound on the fusee pully 28. As the cover is withdrawn the cord 26 is wound off the pully 28 onto the pully 27. The purpose of these pully shapes is to provide equal tension of the cover during the pulling out and retracting. Knowing the maximum and minimum diametres of the cloth as it comes off the reel, the spring characteristics and the number of turns, it is possible by varying the diameter of one or both pullies to keep the tension on the cover constant.

By keeping to a minimum the number of revolutions of the reel to unwind the cover the number of grooves in the pullys is also kept small. To keep the reel revolutions to a minimum the minor diametre of the reel should be made as large as possible. This requirement must be balanced against the need to kept the overall size of the housing to a minimum.

Any spring return device will tend to use up all the energy stored in the spring when it retracts. In order to limit the number of turns that the reel can make it is proposed to have a limiting device. This may comprise a nut 30 rotatable on a screw 31. The screw 31 is fixed to the housing 1 and the nut 30 is driven up and down the screw 31 by the rotation of the reel 5, the nut 30 being free to slide but not to turn. The reel movement is limited by the housing 1 when screwed down and by the pin 32 when wound up.

Reference is now made to the electrical and electronic arrangements for the cover retraction and the intrusion alarm system.

The arrangements will use known techniques and will vary according to the type of structure to be covered and the sophistication of the control and alarm systems required. Referring first to the motor control arrangement, the stop, start and motor speed need to be controlled. This would usually be a position sensing device of the reel mounted at an appropriate place in the retractor assembly. Basically it would be a rotational sensor which feed information such as speed, direction and number of revolutions back to a central electronic unit. This device may be an optical infra red detector, variable reluctance, magnetic operated switch, capacitive coupling, multi turn potentiometer, brush contact type or mechanically operated switches.

The speed information can be used to detect an obstruction situation whilst the fabric on the cover is being retracted. Upon detecting this condition for a required time necessary to stop nuisance tripping the motor shall stop rotation. To restart, a small movement in the opposite direction shall serve as a signal that the obstruction has been removed and start retraction again. The two parameters used are the speed for obstruction detection and direction for restart the signal. A simpler way of restarting the motor would be to have at least an additional electric switch.

In one arrangement the controlling technique is pulse width modulation to ensure low current disipation. Pulse generation is achieved by an infra red beam passing through a circle of teeth fitted to the reel, the interupted beam inpinging on an infra red detector.

Figure 6:
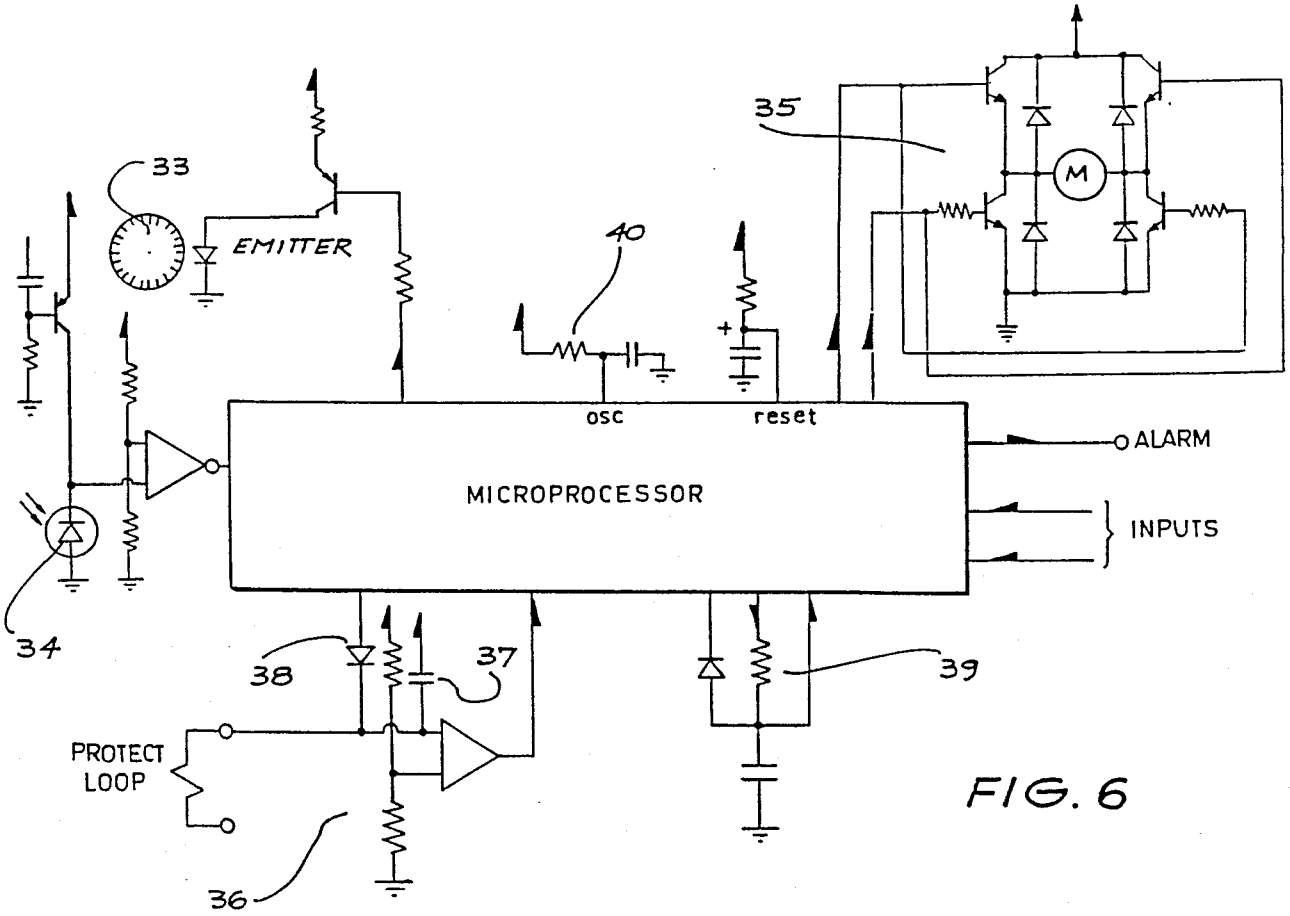
FIG. 6 is an example of the electronics for retraction control and an alarm system.

Reference will now be made to FIG. 6.

The ring of teeth or slots 33 is fixed to and rotates with the reel 5 and the pulse light signal falls on the photo diode 34. The resulting electrical pulses are fed to the micro processor which interprets the pulses and transmits controlling signals to the motor control circuit 35.

Reference is now made to the alarm system.

By including a detection path in the cover itself then a fully detectable envolope is formed. Several methods may be used such as:

1. A resistive loop formed by several parallel resistances integrated with the cover.

2. An RF coupling loop within the cover so a stepwise disturbance results in the alarm being activated, 3. Propagation (phase shift) through the cover; a pulse is emitted through the conductive path in the cover and its time delay measured and compared against the known standard, namely, the measured response when the alarm is activated; any disturbance such as cutting the fabric, disconnecting return path or shorting path out, would register as a tamper situation and activate the alarm, 4. Fiber optical system—a fine optical path can be implemented throughout the fabric in much the same manner as above.

A protective resistance loop system is shown at 36 on FIG. 6. When the alarm is switched on the capacitor 37 charges through the protective loop and the time taken to reach a reference voltage is measured by the micro processor and stored for subsequent reference. The micro processor initiates repeated readings of the condition of the resistive loop to determine its condition. Each time a reading is required the capacitor 37 is discharged by the micro processor through the diode 38.

The capacitor 37 will then commence to charge and the time taken to reach the reference voltage is measured by the micro processor and compared with the reference time. This will give a measure of the condition of the resistance loop. As the reference time is assessed each time the alarm system is initially swiched on this method allows for variation in the resistance of the loop due to varying weather conditions, lapse of time etc.

A look up time constant circuit 39 is used so that some adjustment of motor speed characteristics can be obtained in the event of different types of motors being used. A time constant is read and stored at regular intervals and provides an input to the speed determining circuitry.

One of the inputs would be from a manual key to enable the alarm system. There would be a time delay before the alarm is fully operational. Another key operated input signal may be used in relation to the belmouth plug whereby the signal signifies a fully-home position to the micro processor so that any errors that may arise can be zeroed at each usage.

INDUSTRIAL APPLICATION

The cover device of the invention is designed for any application when a temporary cover is required and where easy to use retraction and neat storage of the cover is required. Its primary use is for the temporary cover and protection of motor cars though it has obvious other uses such as for swimming pools, boats, the load area of trucks, awnings etc.

We claim:

1. A retracting cover device for covering structures such as vehicles, swimming pools, boats, awnings etc., comprising a cover of wide flexible sheet material, a reel rotatably mounted on reel support means for winding on and winding off the cover, retracting mechanism for rotating the reel to wind up the cover thereon for storage, said reel being of very narrow width compared to the cover width and means for gathering the cover to enable winding onto the narrow reel.

2. A cover device as claimed in claim 1 wherein the reel support means comprises a housing for the cover device.

3. A cover device as claimed in claim 2 wherein the housing has a suitable shape to fit an available space on the structure.

4. A cover device as claimed in claim 1, wherein the device forms part of the original structure.

5. A cover device as claimed in claim 1, wherein the device can be added to an existing structure.

6. A cover device as claimed in claim 1 wherein the retracting mechanism is operated by an electric motor.

7. A cover device as claimed in claim 6 having gearing between the motor and the reel.

8. A cover device as claimed in claim 7 having disengaging means between the motor and the reel.

9. A cover deivce as claimed in claim 8 wherein the disengaging means is a centrifugal clutch.

10. A cover device as claimed in claim 8 wherein the disengaging means is a solenoid.

11. A cover device as claimed in claim 8 wherein the disengaging means is a pivoting gear.

12. A cover device as claimed in claim 1 wherein the retracting means is a spring motor.

13. A cover device as claimed in claim 1 wherein the device is fitted to one end of the structure and means are provided for attaching the cover to the other end of the structure.

14. A cover device as claimed in claim 13 wherein the means for attaching the cover are lockable.

15. A cover device as claimed in claim 1 wherein theft-alarm means are built into the cover.

16. A cover device as claimed in claim 15 wherein the alarm means is electrically operated.

17. A cover device as claimed in claim 16 wherein the alarm means includes a conductive path or paths through the cover.

18. A cover device as claimed in claim 17 wherein the alarm means is made operational using direct current, radio frequency coupling or phase shift pulses.

19. A cover device as claimed in claim 15 wherein the alarm means includes a fibre optical path in the cover.

20. A cover device as claimed in claim 1 comprising a position sensing device for the reel.

21. A cover device as claimed in claim 20 wherein the position sensing device is a rotational sensor.

22. A cover device as claimed in claim 1 wherein the means for gathering the cover comprises a bell mouth of relatively small size compared to the width of the cover.

23. A cover device as claimed in claim 22 wherein the bell mouth is located in the housing of the device.

24. A cover device as claimed in claim 22 wherein the bell mouth is located at or in the wall of the structure and connected by a guiding duct to the device.

25. A cover device as claimed in claim 22 wherein the outer end of the cover is fitted with a plug to close the bell mouth.

26. A cover device as claimed in claim 2 wherein part of the housing is detachable for cleaning the housing and the cover.

27. A cover device as claimed in claim 2 wherein the housing has drainage outlets.

28. A cover device as claimed in claim 6 wherein the cover has a switch for actuating the electric motor.

* * * * *